US005910325A

United States Patent [19]

Hvidegaard

[11] Patent Number: 5,910,325

[45] Date of Patent: Jun. 8, 1999

[54] SYSTEM FOR MOULDING TUBULAR GOODS

[75] Inventor: Johannes Hvidegaard, Brønderslev, Denmark

[73] Assignee: Pedershaab A/S, Bronderslev, Denmark

[21] Appl. No.: 08/930,268

[22] PCT Filed: Mar. 27, 1996

[86] PCT No.: PCT/DK96/00122

§ 371 Date: Dec. 18, 1997

§ 102(e) Date: Dec. 18, 1997

[87] PCT Pub. No.: WO96/30178

PCT Pub. Date: Oct. 3, 1996

[30] Foreign Application Priority Data

Mar. 28, 1995 [DK] Denmark ..... 0320/95

[51] Int. Cl.[6] ..... B28B 21/14

[52] U.S. Cl. ..... 425/456; 425/432

[58] Field of Search ..... 425/262, 421, 425/425, 426, 432, 456

[56] References Cited

U.S. PATENT DOCUMENTS

| | | | |
|---|---|---|---|
| 586,569 | 7/1897 | Sherman | 425/456 |
| 915,331 | 3/1909 | Bongardt | 425/456 |
| 1,747,555 | 2/1930 | Pelton | 425/456 |
| 3,201,843 | 8/1965 | Osweiler | 425/413 |

FOREIGN PATENT DOCUMENTS

| | | |
|---|---|---|
| 208148 | 3/1909 | Germany . |
| 507 792 | 7/1971 | Switzerland . |
| WO94/00281 | 1/1994 | WIPO . |

*Primary Examiner*—James P. Mackey

*Attorney, Agent, or Firm*—Finnegan, Henderson, Farabow, Garrett & Dunner, L.L.P.

[57] ABSTRACT

A system for the molding of tubular goods, comprising at least one mold having an inner mold part and an outer mold part which together define a mold cavity and an upwardly open annular pouring gate, the system additionally comprising a plurality of vibrators and devices for lifting the vibrators from and lowering these into the mold cavity through the annular pouring gate. The positioning devices are adapted to displace the vibrators radially with respect to the annular pouring gate, and each of the positioning devices is provided with a separate controllable drive unit which is adapted to displace the vibrators individually. This results in a more flexible system for the molding of tubular goods which may be adapted to various pipe types, such as egg-shaped, four-sided, circular and other forms.

10 Claims, 4 Drawing Sheets

SYSTEM FOR MOULDING TUBULAR GOODS

BACKGROUND OF THE INVENTION

1. Field of the Invention

The present invention concerns a system for the molding of tubular goods, comprising a mold having an inner mold part and an outer mold part which together define a mold cavity and an upwardly open annular pouring gate.

2. Description of the Related Art

When molding concrete pipes, for example, in such vertical molds, with the concrete being poured from the upper end of the mold, it is important that vibration is imparted to the poured concrete material to compact the concrete so that there will no voids in the cast concrete article. Today, the vibrations are imparted either by introducing poker vibrators down through the upper opening of the mold, or by imparting vibrations to either the inner mold part or to the outer side of the mold via the platform which carries the mold, for example, so that the vibrations spread via the mold into the concrete.

Particularly in connection with the so-called wet molding of concrete elements where the cast concrete element remains in the mold for a relatively long time, as the element is demolded only after the establishment of a bonding force between the concrete particles that is greater than the friction between the cast concrete element and the mold, it is important to keep down the mold costs, since the costs of such molds in mass production systems may be quite considerable because of the necessity of using several molds of the same type.

This problem is aggravated today by the increasing use of tubular goods of widely varying cross-sections, such as egg-shaped, four-sided and other cross-sections, which additionally increases the mold costs in a system of this type. In a system enabling switching between various forms of basic cross-sections, it has been attempted to keep down the mold equipment costs by reusing removable vibrators on the outer mold part of the various mold shapes and sizes. Although the relatively expensive vibrators are thus reduced considerably in number, it is clear that the actual mold equipment is made more expensive in any event, since the mold equipment has to be provided with mounting fittings or mating flanges to connect the individual mold with the vibrators.

Today, a system is known where the mold costs are minimized in that the system is provided with a plurality of poker vibrators, which are suspended over the mold equipment, and which may be lowered down into the mold during the molding process and be pulled up as the mold is filled. This known system is additionally adapted such that the individual vibrators may be displaced synchronously in a radial direction with respect to the mold, so that the system may be used for the molding of circular pipes of different diameters.

SUMMARY OF THE INVENTION

Accordingly, the object of the present invention is to provide a system for the molding of tubular goods of the last-mentioned type, comprising molds having an inner mold part and an outer mold part which together define a mold cavity with an upwardly open annular pouring gate, said system additionally comprising a plurality of vibrators and means for lifting and lowering the vibrators from and into the mold cavity through the annular pouring gate, said vibrators being suspended from a plurality of positioning devices which are adapted to displace the vibrators radially with respect to the annular pouring gate. Such a system, in contrast to the last-mentioned prior art, may additionally be used for the molding of egg-shaped or four-sided pipe elements, for example, without necessitating a cost-increasing adaptation of the individual molds.

The aforementioned advantages are achieved according to the invention in that the positioning devices are provided with a separate controllable drive unit which is adapted to displace the vibrators individually.

This makes it possible for the vibrators, which hang down from the individual positioning devices, to be positioned arbitrarily with respect to each other, so that the system may be used for the molding of widely different pipe types, i.e., circular as well as egg-shaped and four-sided and other pipe types. In addition, the system is easy to adjust, thereby enabling filling of molds which are not positioned accurately with respect to the system.

When an independent drive unit is provided for each drum for rolling up the flexible hose, it is ensured that the height of the individual vibrator may be adjusted independently, irrespective of the pipe geometry which is desired. It is moreover ensured that the number of vibrators may be varied, as desired.

Each positioning device may expediently comprise a spindle and an associated spindle carriage from which the vibrator hangs in the flexible hose, said positioning devices being mounted in a circle so that the spindles at one end point toward each other. When the drum of each positioning device is mounted on a substantially horizontal shaft, and the spindle extends completely below the drum, it is ensured that the external dimensions of the system may be minimized with respect to the desired maximum pipe dimension which the system must be capable of producing.

A particularly expedient embodiment is one in which the drum and the spindle with associated spindle carriages are built together as an integral unit. This provides the advantage that the system may be constructed extremely flexibly, as regards the number of the individual positioning devices in the system as well as their mutual positions.

In this connection, a particularly expedient structure is provided where the system has a frame with a circular continuously extending mounting rail, and where each of the positioning devices is releasably secured to the mounting rail. This enables the individual positioning devices to be positioned with different spacings from each other, thereby ensuring that the positioning devices, when molding four-sided pipes, for example, may be concentrated around the corners of the pipes so that uniform and sufficient compaction of the concrete is obtained in these corners in the mold.

The system may additionally comprise a device for distributing molding material, said device comprising a conveyor or chute which is rotatably mounted about a substantially vertical axis extending down through the inner mold part of the mold, said conveyor or chute having an outlet end, means being provided for automatically displacing the distance of the outlet end from, the vertical axis in such a manner that the outlet end follows the contour of the inner mold part during the rotation of the conveyor or the chute. This additionally reduces the mold costs, since the individual mold does not have to be provided with chutes at the top of the mold with a view to leading the concrete down into the mold.

When means are provided for adjusting the feed speed of the conveyor and/or the speed of rotation of the chute, the concrete will be filled extremely uniformly in the mold, which is important in particular when molding pipes having a greatly varying distance to the centre of the pipe, or having a varying wall thickness.

BRIEF DESCRIPTION OF THE DRAWINGS

A preferred embodiment of the invention will be described more fully below with reference to the drawing, in which.

DESCRIPTION OF THE PREFERRED EMBODIMENTS

Figure 1:
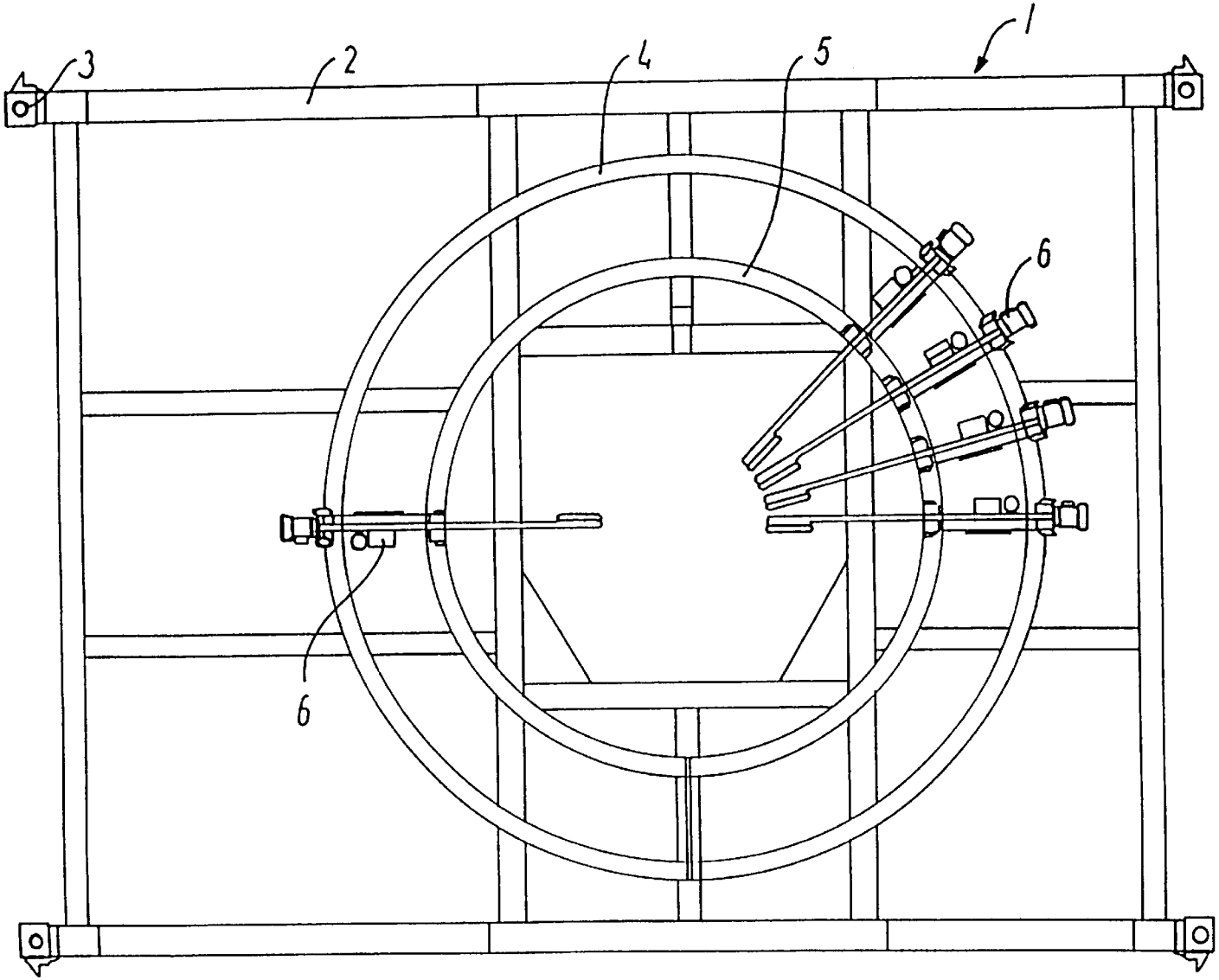
FIG. 1 is a bottom view of a partially extended system of the invention.

FIG. 1 shows a platform 1 for a system of the invention, said platform 1 consisting of a four-sided frame element 2 which is provided at its corners with suspension points 3 constructed in a known manner such that the suspension points 3 are provided with threads, so that the platform 1 may be suspended from a parallel guide consisting of four threaded spindles which extend down through the suspension points 3.

According to the invention, the platform 1 is provided with a set of circular mounting rails 4 and 5 which mount a plurality of positioning devices 6. For clarity, only five positioning devices 6 are shown. As appears from FIG. 1, the positioning devices 6, which are firmly mounted on the circular mounting rails 4 and 5, may be mounted at various locations on the circular mounting rails 4 and 5 with the same or different mutual spacing.

Figure 2:
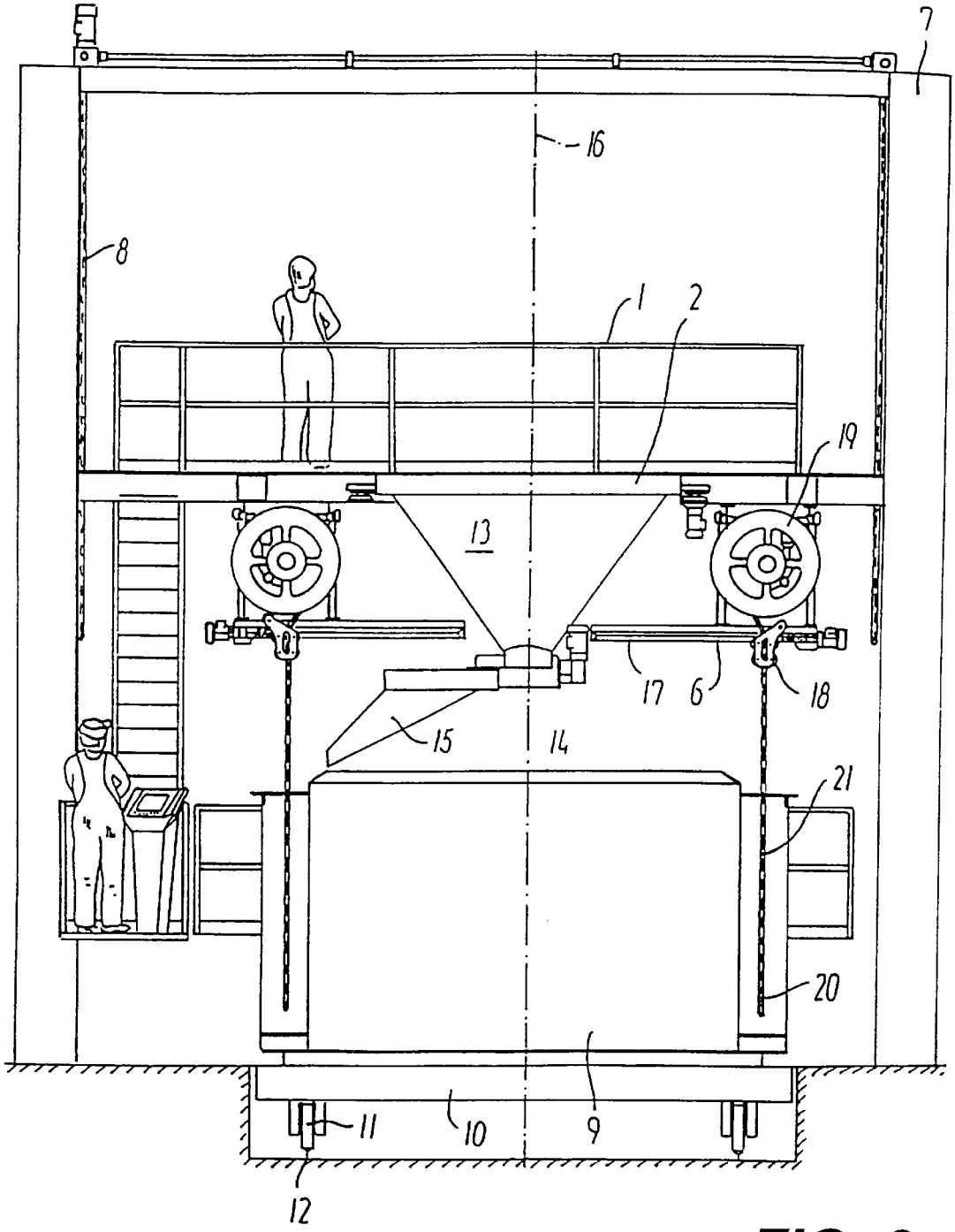
FIG. 2 is a lateral partially sectional view of the system of FIG. 1 in an operating situation.

FIG. 2 is a lateral view a system of the invention with a platform 1 of FIG. 1. The system is constructed with a frame 7 provided with spindles 8 from which the platform 1 is suspended at the suspension points 3. The platform 1 may hereby be raised or lowered, as needed, so that the system may be used for molding in molds of different heights. FIG. 2 thus shows a sectional view of a mold 9, which is placed on a carriage 10 provided with wheels 11 which can run on the rails 12.

The platform 1 mounts a concrete silo 13 provided at its lower end with a conveyor 14 and a chute 15, which is constructed in such a manner that the chute 15 rotates about the vertical axis of symmetry 16 which extends down through the silo 13, such that the chute 15 follows the outer contour of the mold 9 when concrete is poured from the silo 13 down into the mold.

In addition, as shown in FIG. 1, the platform 1 is provided with a plurality of positioning devices 6, which each comprise a spindle 17 with an associated spindle carriage 18 as well as a drum 19 for the suspension of vibrators 20 from a flexible hoses 21. As can be seen in FIG. 2, the inner ends of at least some of the spindles 17 point toward each other as a result of the mutual spacing of the positioning devices 6 on which the spindles are carried.

As shown in FIG. 2, the platform 1 may expediently also be provided with a control panel 22 for an operator which can adjust the operating processor of the system. The control system will not be described in detail here, as it will be obvious to a skilled person to provide an embodiment of such a control system as well as algorithms for establishing it on the basis of this description.

Figure 3:
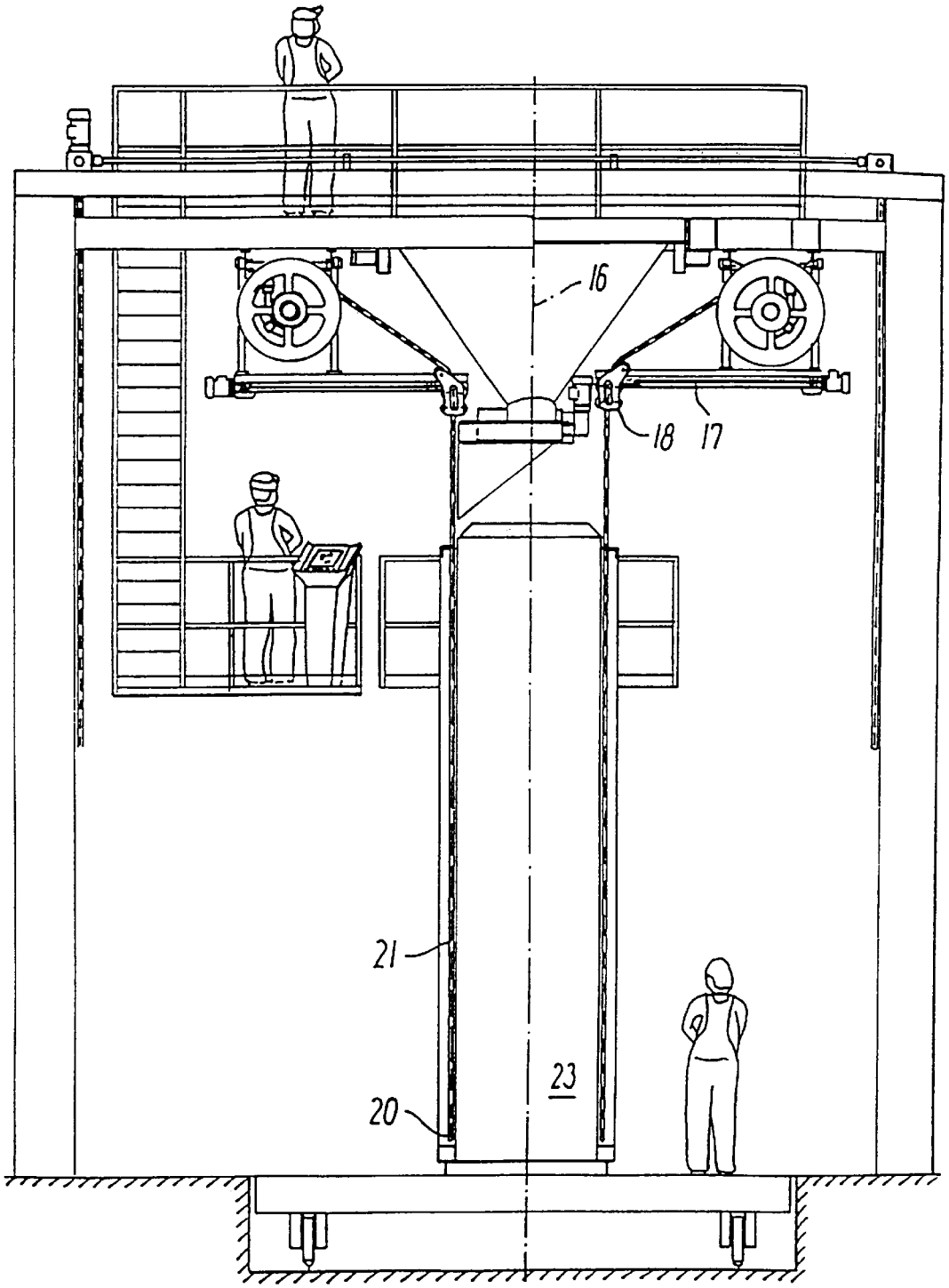
FIG. 3 is a view of the system of FIG. 2 in another operating situation.

FIG. 3 now shows the same system as shown in FIG. 2 in another operating situation, where a pipe 23 is molded in a mold 23 of another dimension than the mold 9 of FIG. 2. As will be seen, the vibrators, which are suspended from the flexible hoses 21, are displaced inwards toward the line of symmetry 16 of the system by means of the spindles 17 and the associated spindle carriages 18.

It will moreover be seen that also the chute 15 is displaced inwards toward the axis of symmetry 16 of the system.

Thus, it will be seen from FIGS. 2 and 3 how the system may be adapted in a simple manner to molding jobs with molds, e.g., of the wet molding type, with great variations as regards the dimensions of the molds 9, 23 with respect to height as well as diameter.

Figure 4:
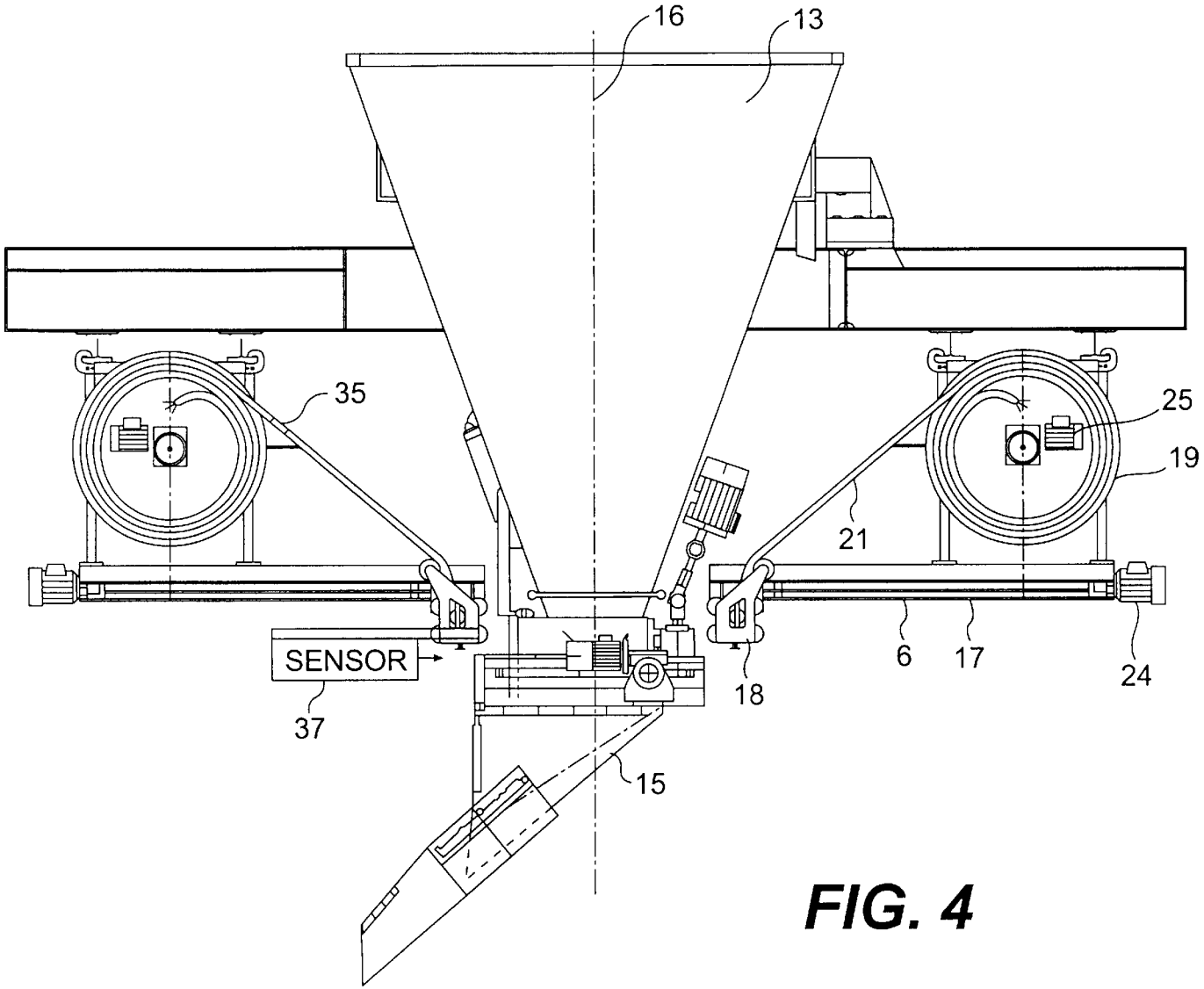
FIG. 4 is lateral partially sectional view of part of the system of FIGS. 2 and 3.

According to the invention, the positioning devices 6, as shown clearly by FIG. 4, are individually provided with a motor 24 of its own for driving the spindle 17 and thereby the spindle carriage 18, which positions the flexible hose 21 with the vibrator 20, which is not shown in this figure. The positioning device 6 thus indicates how the flexible hose 21 is rolled up on a drum 19, which, according to an expedient embodiment of the invention, is driven by an independent motor 25. The flexible hose 21 extends from the drum, out through the spindle carriage 18, and hangs vertically down from the carriage 18. The drum 19 is mounted on a horizontal shaft, and the spindle 17 extends at a level completely below the drum 19. As show schematically in FIG. 4, each flexible hose is fitted at a position along the length thereof with a detectable element 35, and a sensor 37, preferably mounted on the spindle carriage 18 on the positioning device 6, detects location of the detectable element 35 to provide an indication of the height of each vibrator 20 relative to the positioning devices 6.

Thus, the vibrator 20, which hangs down from the flexible hose 21, may be positioned in a simple and flexible manner by displacement of the spindle carriage 18 on the spindle 17 by means of the drive motor 24, so that the individual positioning devices 6, since each of them is provided with a separate drive motor 24, may be adjusted in such a manner that the vibrators 20 hang down in a pattern which corresponds to the contour of an arbitrary mold. Thus, the system may be adapted to molds of different basic shapes, so that the molds 9, 23 shown in FIGS. 2 and 3 may have a circular, four-sided, egg-shaped, oval or other cross-section.

What is claimed is:

1. A system for molding tubular goods, comprising at least one mold having an inner mold part and an outer mold part defining a mold cavity and an upwardly open annular pouring gate, said system additionally comprising a plurality of vibrators and means for lifting and lowering the vibrators from and into the mold cavity through the annular pouring gate, said vibrators being suspended from a plurality of positioning devices adapted to displace the vibrators radially with respect to the annular pouring gate, wherein each of the positioning devices is provided with a separate controllable drive unit to displace the vibrators individually.

2. A system according to claim 1, wherein each vibrator hangs from the positioning device on a flexible hose, and a drum for rolling up the flexible hose is provided at each positioning device.

3. A system according to claim 2, wherein each drum is driven by an independent drive unit, and including means for adjusting the height of the individual vibrators with respect to the corresponding positioning device.

4. A system according to claim 3, wherein the means for adjusting the height of the individual vibrators comprises a sensor attached to the corresponding positioning device at the flexible hose, and an element detectable by the sensor and located on the flexible hose.

5. A system according to claim 3 or 4, wherein each positioning device comprises a spindle and an associated spindle carriage from which the vibrator hangs on the flexible hose, and the positioning devices are mounted in a circle so that the spindles point toward each other at one end.

6. A system according to claim 5, wherein the drum on each positioning device is mounted on a substantially horizontal shaft, and the spindle extends at a level completely below the drum.

7. A system according to claim 5, wherein the drum and the spindle with associated spindle carriage are an integral unit.

8. A system according to claim 7, wherein the system has a frame with a continuously extending circular mounting rail, and the positioning devices are releasably secured to the mounting rail individually.

9. A system according to claim 1, wherein the system additionally comprises a device for distributing molding material, said distributing device comprising a conveyor or chute rotatably mounted about a substantially vertical axis extending down through the inner mold part of the mold, said conveyor or chute having an outlet end, means being provided for automatically displacing the distance of the outlet end from the vertical axis in such a manner that the outlet end follows the contour of the inner mold part during the rotation of the conveyor or the chute.

10. A system according to claim 9, including means for adjusting the feed speed of the conveyor and/or the speed of rotation of the chute in such a manner as to achieve uniform filling in the mold.

* * * * *